United States Patent [19]

Nilson

[11] 4,141,474

[45] Feb. 27, 1979

[54] SELF-CLOSING CLOSURE UTILIZING A SINGLE DIAPHRAGM

[75] Inventor: Nils B. Nilson, Mjolby, Sweden

[73] Assignee: KeNova AB, Malmo, Sweden

[21] Appl. No.: 703,794

[22] Filed: Jul. 9, 1976

[51] Int. Cl.[2] ..... B65D 35/50

[52] U.S. Cl. ..... 222/493

[58] Field of Search ..... 222/499, 492–496

[56] References Cited

U.S. PATENT DOCUMENTS

| | | | |
|---|---|---|---|
| 2,628,004 | 2/1953 | Schlicksupp | 222/493 |
| 3,321,114 | 5/1967 | Croyle | 222/499 |

FOREIGN PATENT DOCUMENTS

| | | |
|---|---|---|
| 1586697 | 8/1970 | Fed. Rep. of Germany. |
| 1106499 | 3/1968 | United Kingdom. |

*Primary Examiner*—Joseph F. Peters, Jr.
*Assistant Examiner*—Norman L. Stack, Jr.
*Attorney, Agent, or Firm*—Finnegan, Henderson, Farabow & Garrett

[57] ABSTRACT

A self-closing closure for a tube or package having a resilient wall for dispensing flowable material upon the application of pressure on the tube, utilizing a relatively stiff spider for supporting an outwardly extending valve stem having a closed outer surface and a diaphragm member having its periphery interconnected with the periphery of the spider to form a closure unit and its inner portion forming a valve with the valve stem. The diaphragm member is formed with a relatively thick flange substantially parallel with the walls of the tube for interconnection therewith, a relatively thin, resilient planar portion extending inwardly toward the stem, and a substantially tubular portion surrounding the stem and terminating in an open lip which makes a close, sliding fit with the outer surface of the stem.

The resilient, planar portion of the diaphragm member is normally concave, being formed with an unstressed negative angle of substantially 5° to 15° with a plane perpendicular to the longitudinal axis of the tube. When assembled with the spider, the stem interacts with the lip of the tubular portion of the diaphragm member to reduce the negative angle by about 2° and to form a secure closure in the rest position of the planar portion. When pressure on the tube above a predetermined value is applied, the planar portion of the diaphragm member is forced outwardly by the contents of the tube to a convex shape having a positive angle not to exceed 8°, carrying the lip of the tubular portion away from the stem and opening the valve. Upon release of the pressure on the tube, the planar portion of the diaphragm member automatically returns to its rest position having a concave configuration with respect to the flange and the tube and securely closing the tube.

15 Claims, 4 Drawing Figures

SELF-CLOSING CLOSURE UTILIZING A SINGLE DIAPHRAGM

BACKGROUND OF THE INVENTION

Field of the Invention

This invention relates to a closure for a resilient dispensing tube or package and more particularly to a self-closing closure utilizing a diaphragm.

Self-closing closures for tubes or the like for dispensing flowable material upon the application of pressure upon the tube have been well known for many years. Continuing efforts have been made to develop such closures which are inexpensive to manufacture and yet absolutely secure for cutting off the flow of material and sealing the tube upon the relaxation of pressure on the tube.

U.S. Pat. No. 2,025,810 which issued Dec. 31, 1935 to W. Dinnes teaches a self-closing closure using a single diaphragm. In this device a planar diaphragm having an aperture therein is formed to have a rest position surrounding the top of a stem. Upon application of pressure on the tube, the diaphragm is bowed outwardly to open the valve and upon release of pressure the patent states that the diaphragm returns to its rest position. Any small amount of pressure on the tube would tend to deflect the diaphragm outwardly so that the closure is not secure. This closure unit was built to be threaded onto the neck of a tube.

Subsequently, devices were developed in which the closure became an integral part of the tube itself. In the prior art, however, these closure devices were often relatively complicated and expensive to make, have not been secure in their closure of the tube, or have had other operational disadvantages.

BRIEF SUMMARY OF THE INVENTION

It is therefore the primary object of this invention to improve self-closing closures for dispensing tubes and packages having at least one resilient wall.

It is another object of this invention to provide improved self-closing closures whose diaphragms move from a concave to a convex position during the operation of the closure to provide adequate discharge area for the substance being dispensed, and return automatically to a concave position to provide a tight seal when dispensing terminates.

It is a further object of this invention to reduce the cost and improve the closing security of tubes or the like for dispensing flowable material upon the application of pressure to the tube.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the self-closing closure of this invention comprises a spider member having a peripheral portion and an outwardly extending valve stem having an outer surface, and a diaphragm member including a relatively thick flange portion for interconnecting with the peripheral portion of the spider to form a closure unit, a relatively thin resilient planar portion extending inwardly toward the valve stem, and a substantially tubular portion surrounding the stem and terminating in an open lip which makes a close, sliding fit with the outer surface of the valve stem to form a valve with the stem, the planar portion of the diaphragm being formed to have an unstressed concave configuration with respect to the flange, and the stem pressing against the lip in the closed position of the planar portion to lift the planar portion from its formed position to a stressed rest position for securing the closure of the valve by reducing the concavity of the planar portion. When the valve is opened by pressure on the tube, the planar portion reaches a convex configuration, returning to the stressed concave rest position when the pressure is released.

It is preferred that the planar portion of the diaphragm member be formed with a negative angle of substantially 5° to 15° with a plane perpendicular to the longitudinal axis of the tube and that, when assembled with the spider, the stem interacts with the lip of the tubular portion of the diaphragm member to reduce the negative angle by about 2°.

BRIEF DESCRIPTION OF THE DRAWINGS

The accompanying drawings, which are incorporated in and constitute a part of this specification illustrated one embodiment of the invention and, together with a description, serve to explain the principles of the invention.

Of the drawings.

DETAILED DESCRIPTION OF THE PREFERRED EMBODIMENTS

Reference will now be made in detail to the preferred embodiments of the invention, examples of which are illustrated in the accompanying drawings.

Figure 1:
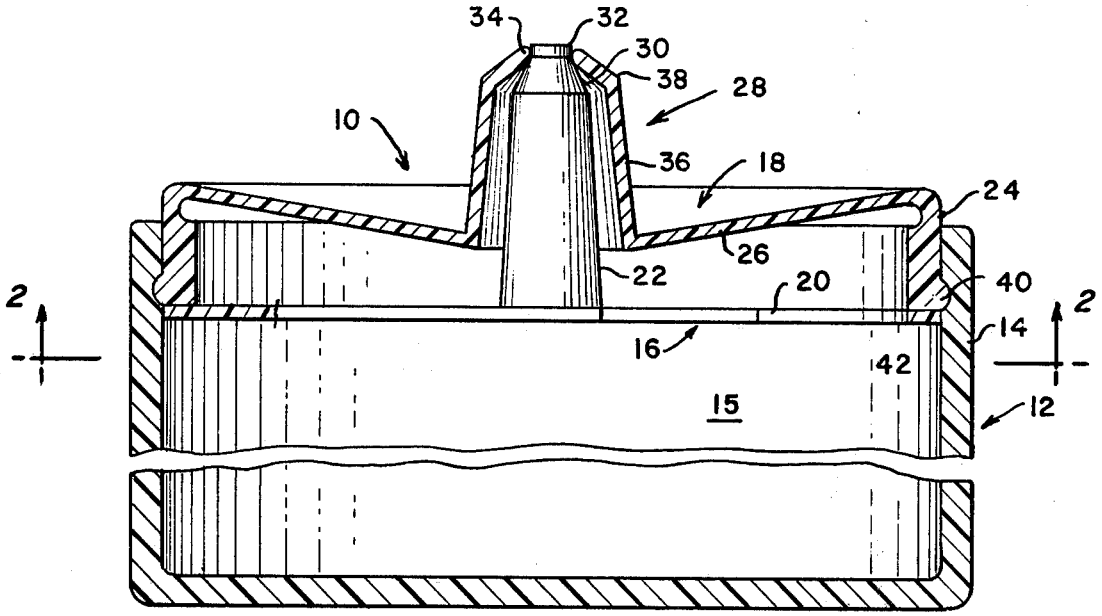
FIG. 1 is a cross section of one embodiment of the closure of the invention inserted into the open end of a tube.

Referring to FIG. 1, it will be seen that a closure 10 is inserted in the end of a tube 12 having a wall 14, enclosing a flowable substance 15 in the tube.

In accordance with the invention, the closure 10 includes a spider member 16 and a diaphragm member 18. As embodied herein, the spider member 16 includes a support 20 and a valve stem 22. The diaphragm member includes a flange 24, a planar portion 26 extending inwardly toward the stem 22, and a tubular portion 28.

Figure 2:
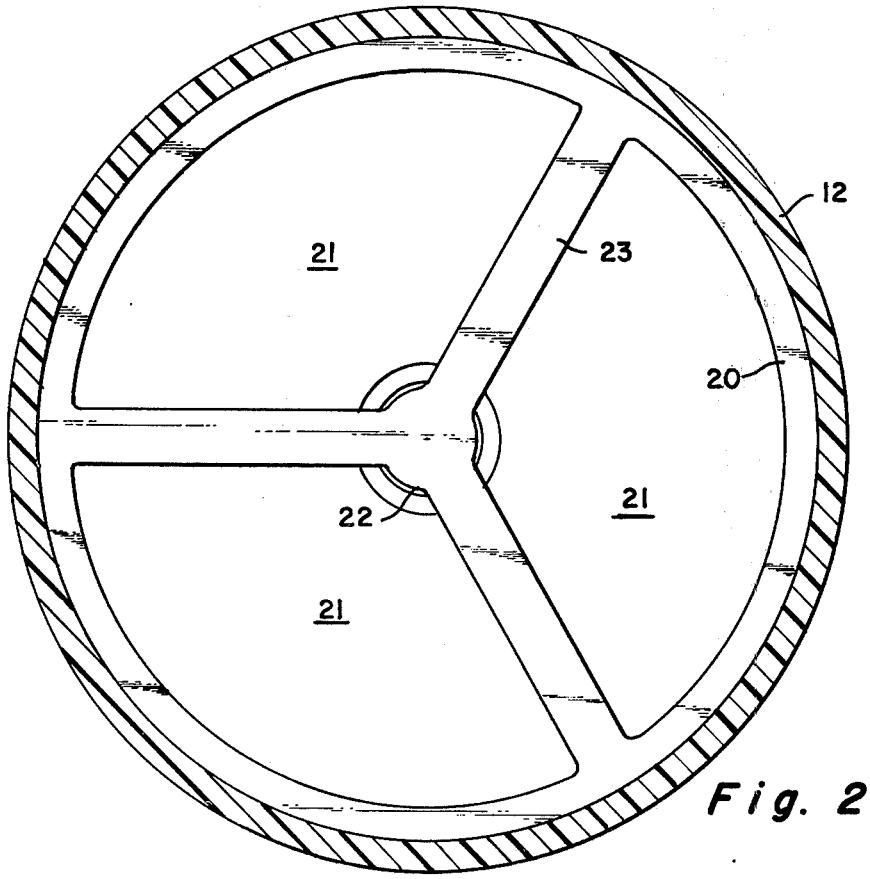
FIG. 2 is a cross section of the embodiment of FIG. 1 taken along the lines 2—2.

The support 20 of the spider 16 has a plurality of cut out areas 21, as shown in FIG. 2, for allowing the flowable material dispensed by the tube 12 to be forced through the support member of the spider. Preferably, the support member 20 is formed with three spoke-like members 23 intersecting at the longitudinal axis of the tube on which intersection is supported the valve stem member 22. The support 20 should be of sufficient strength that the valve stem 22 is substantially immovable as the material dispensed by the tube is forced through the support.

As embodied herein, the stem 22 has a circular cross section and extends outwardly beyond the end of the tube, the surface of the stem being preferably graduated as to its cross sections to form a cone-like surface. Preferably, toward the outer end of the stem, a portion 30 is more steeply graduated, forming a frustum of a cone and at the end of the stem a collar portion 32 is again less steeply graduated, and may be cylindrical.

As embodied herein, the flange 24 of the diaphragm 18 is relatively thick and interconnects with the periphery of the support 20 of the spider member 16 to form a closure unit, the unit being inserted into the end of the wall 14 of the tube 12. The resilient, planar portion 26 of the diaphragm member is formed to be concave with respect to the wall of the tube in the normal rest position of the diaphragm member. As formed, the planar portion 26 in its unstressed concave configuration has a negative angle of about 5° to 15° with a plane perpendicular to the longitudinal axis of the tube. The tubular portion 28, integral with the planar portion 26 and the flange 24, extends outwardly along and spaced from the surface of the stem 22 and terminates in an open circular lip portion 34. Lip 34 makes a close, sliding fit with the outer surface of the stem 22 in the closed position of the closure to form a valve with the stem.

In the preferred embodiment of FIG. 1, the tubular portion 28 of the diaphragm member 18 includes a frusto-conical portion 36 extending along and spaced from the stem 22 and a more sharply inclined portion 38 terminating in the lip 34. The lip 34 is shaped to fit snugly into the intersection of the more sharply graduated portion 30 and the collar 32 of the stem 22.

Figure 3:
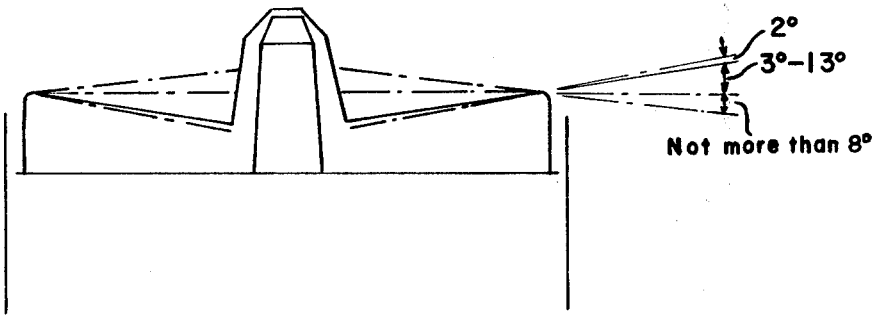
FIG. 3 is a schematic representation of the movement of the diaphragm of FIG. 1.

In accordance with the invention, the valve stem 22 is pressed into and against the lip 34 of the diaphragm member 18 to lift the planar portion 26 of the diaphragm member about 2° when the diaphragm member and the spider member are assembled into the closure unit. As a result of the pressure of the stem against the lip 34, the rest position of the planar portion of the diaphragm 18 when assembled forms a negative angle of substantially 3° to 13° with a plane normal to the longitudinal axis of the tube, as shown in FIG. 3, stressing the diaphragm in its rest position.

When the spider member 16 and the diaphragm member 18 are fitted together, substantially no radial pressure should be developed to avoid any adverse effect on the action of the diaphragm.

Preferably, in the closed position the lip 34 abuts the valve stem at the intersection of the frustum of the cone 30 and the cylindrical portion 32 and is formed to have a surface complementary to the intersection.

The height of the valve stem 22 may vary, as convenient, along with the height of the tubular portion 28 of the diaphragm member for functional and aesthetic purposes. In any case, however, the height of the stem and the dimensions of the portions of the diaphragm member should be so interrelated that, upon assembly, the stem lifts the diaphragm member by an angle of about 2° from its formed rest position to its assembled rest position.

As embodied herein, under this arrangement the inherent bias of the diaphragm 18 forms a secure closure between the lip 34 of the diaphragm member 18 and the collar and frusto-conical portions of the stem 22. Thus, a tight valve seal against leakage or post-dispensing drippage is provided.

It is advantageous for the user of the tube to be able to actuate the valve to dispense the contents of the tube without having to exert undue pressure on the tube. The flowability of the material to be dispensed is a factor which must be taken into consideration.

For free-flowing products, the diameter of the diaphragm member 26 may be, for example 15–35 millimeters (preferably 20–35 mm) and the negative, assembled rest angle of the planar portion of the diaphragm member preferably is about 10°. For pasty products, the corresponding negative angle would be about 12°.

If the valve diameter, i.e. the diameter of the diaphragm member 26, is increased the same lever arm movement is achieved by a smaller negative rest angle. For valve diameters up to 60 millimeters, assembled negative rest angles down to 5° are normal. For practical purposes, a formed negative angle of 5° to 15° for the planar portion of the diaphragm member 18, with a resulting 3° to 13° assembled negative angle, is operative.

The flange 24 of the diaphragm member 18 may be formed with a bulging ring 40 for snap-fitting into a channel 42 in the wall of the tube. If the closure 10 is snap-fitted into the tube 12, care must be taken that pressure is not exerted on the diaphragm member 18 so as to affect the closure relationship of the diaphragm member 18 with the stem 22. It is preferred that no substantially radial pressure be applied to the closure member 10 by the wall of the tube and, if radial pressure is developed, such pressure should not exceed that which would cause the negative angle of the diaphragm to move more than ±1°.

It is apparent that the closure 10 may be secured in the tube 12 by means other than snap-fitting, as known in the art, such as by soldering, thermo-setting adherents, or rolling reverse flanges. When the closure unit 10 is secured in the tube 12 by one of these alternative means, substantially no radial forces would normally be applied to the diaphragm member 18.

As embodied herein, the flange 24 of the diaphragm member 18 should be relatively thick with respect to the planar portion 26 in order to sustain the radial pressures applied when the planar portion 26 is forced outwardly by pressure on resilient portions of the tube 12. On the other hand, the planar portion 26 must be relatively thin with respect to the flange portion 24 to permit the deflection of the planar portion as the diaphragm moves from its closed rest position to its open position.

Preferably the diaphragm member 18 is formed by injection molding plastic material such as polypropylene, but other forms of manufacture and material can be used. The planar portion 26 of the diaphragm member 18 has a thickness of about 0.20 to 0.40 mm. It is apparent that the material forming the diaphragm member must be strong enough to avoid rupture while retaining the resiliency to deflect under manual pressure on the tube.

As embodied herein, in the open position of the valve the planar portion 26 of the diaphragm member forms a positive angle not to exceed 8°, and preferably not to exceed 5°, with a plane perpendicular to the longitudinal axis of the tube. Preferably the positive angle is between 3° and 5°.

With the specifications stated, as embodied herein, the planar portion 26 of the diaphragm member 18 will return to its original negative rest position when pressure is released on the tube.

The operation of applicant's self-closing closure is such that the action of the diaphragm is practically instantaneous both in opening and in closing the tube. Due to the built-in bias on the diaphragm member, the resilient planar portion 26 does not deflect until a predetermined value of pressure is reached. This pressure will normally vary, depending on the valve dimensions, from about 20 to 200 millibars.

Upon the application of opening pressure to the tube, there is a relatively large axial movement of the planar portion of the diaphragm from its negative-angle closed position to its positive-angle opened position. This movement lifts the lip 34 away from the stem to an extent that a large dispensing passage for the tube contents is provided between the stem 32 and the interior of the tubular portion 28 of the diaphragm. The substance being dispensed can flow relatively unrestricted past the stem 22 and through open lip 34.

The valve of applicant's self-closing closure not only does not leak when the tube is subject to pressure less than the predetermined value, but cuts off cleanly the substance being dispensed and provides a tight seal when the pressure on the tube is released and the planar portion of the diaphragm returns to its negative rest position.

Figure 4:
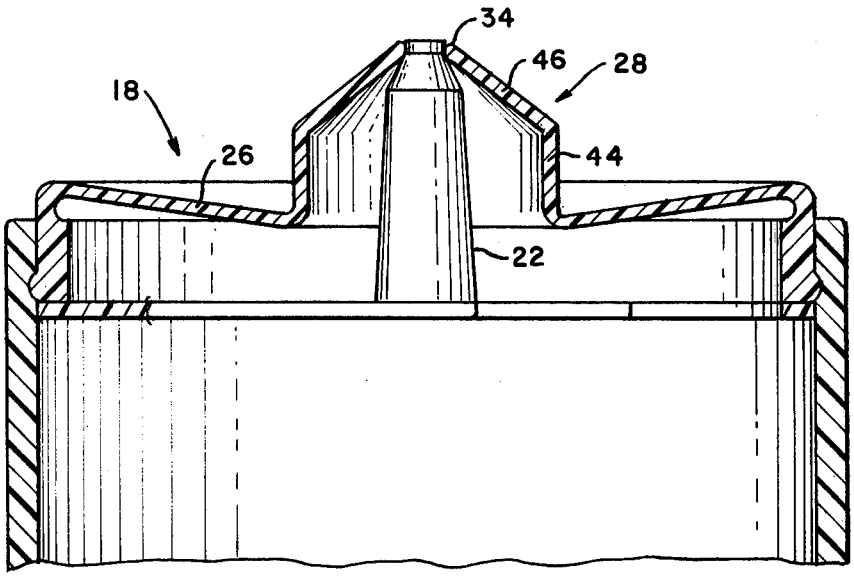
FIG. 4 is a cross section of a second embodiment of the invention.

In the preferred embodiment of FIG. 4 the tubular portion 28 of the diaphragm member 18 is formed with a collar portion 44 having a substantially constant diameter and a sharply inclined portion 46 forming a frustum of a cone and terminating in the lip 34. The planar portion 26 and the collar portion 44 form a stiff hinge where they intersect. In this embodiment a wider passage is provided for the flow of material between the stem 22 and the tubular portion 28 of the diaphragm member 18.

The spider member 16 and the diaphragm member 18 may be very inexpensively formed, for example, of plastic by injection molding as known in the art and may be conveniently assembled as a closure unit by snap-fitting, welding or other known methods.

Although the invention has been particularly described with respect to a tube, the self-closing closure of the invention is equally suited for any dispensing package having at least one resilient wall, in which the contents of the package are dispensed through the closure by pressure on the contents of the package by means of the resilient wall.

The positive and negative angles of the planar portions of the diaphragm have been described with respect to the longitudinal axis of the tube. It is apparent that the angles of the diahragm may also be computed with respect to the longitudinal axis of the stem with the same results.

It will be apparent to those skilled in the art that various modifications could be made in the self-closing closure of the invention without departing from the scope or spirit of the invention.

What is claimed is:

1. A self-closing closure unit adapted to be connected to a package having at least one resilient wall for dispensing the contents of the package upon pressure on the resilient wall comprising:

a spider member having a peripheral portion and an outwardly extending valve stem having an outer surface; and a diaphragm member including a flange portion for interconnecting with the peripheral portion of the spider to form the closure unit, a substantially tubular portion surrounding the stem and spaced therefrom, terminating at its outer end in an open lip which makes a close, sliding fit with the outer surface of the stem to form a valve with the stem; and a relatively thin, resilient planar portion integral with and directly connected to the flange portion and the tubular portion at its inner end, the connection of the planar portion with the flange portion forming a plane and said flange portion restraining said planar portion from expanding radially, said planar portion being formed to have a concave configuration with said plane and said lip sealing against said stem when said valve is closed, and said planar portion having a flexed convex configuration when said valve is opened by pressure on the resilient wall and said planar portion is forced by said pressure through said plane, and said planar portion returning by the flexure to the concave configuration when the pressure on the resilient wall is released.

2. The closure unit of claim 1 wherein said valve stem has a longitudinal axis and wherein said planar portion in said unstressed configuration is formed to have a negative angle of substantially 5° to 15° with a plane perpendicular to said longitudinal axis and wherein in the assembly of said spider with said diaphragm member the pressure of said stem against said lip reduces said negative angle by about 2°.

3. The closure unit of claim 2 wherein said planar portion of said diaphragm member in its convex position forms a positive angle not to exceed 8° with said plane perpendicular to the longitudinal axis of said stem.

4. The closure unit of claim 3 wherein said positive angle is within the range of 3° to 5°.

5. The closure unit of claim 1 wherein said package is formed as a tube and wherein said closure unit includes means for a snap-fit into the wall of a tube and wherein the wall of the tube exerts a radial force on said closure unit for deflecting the negative angle of said diaphragm not to exceed ±1°.

6. The closure unit of claim 1 wherein said spider includes a perforated support member and wherein said valve stem includes a frustum of a cone proximate its outer end and terminates in a short, substantially cylindrical portion.

7. The closure unit of claim 6 wherein said support of said spider member is formed with intersecting radial spokes and wherein said valve stem is positioned at the intersection of said spokes.

8. The closure unit of claim 6 wherein said tubular portion of said diaphragm member is formed with an intermediate portion adjoining said planar portion and a frusto-conical portion interconnecting said intermediate portion and said lip.

9. The closure unit of claim 8 wherein said lip abuts said valve stem in the closed position of said valve at the intersection of said frustum of said cone and said substantially cylindrical section and wherein said lip is formed to have a surface complementary to said intersection.

10. A self-closing closure unit for a tube or the like for dispensing the contents of the tube upon pressure of about 20–200 millibars on the tube comprising:

a spider having a perforated support member with a circular periphery and including a valve stem centrally located on said support member for extending outwardly beyond the wall of the tube, said valve stem including a frusto-conical portion intersecting a substantially cylindrical terminal portion; and a diaphragm member including a flange portion for fitting within the tube and for interconnecting with the periphery of the spider to form the closure unit;

a relatively thin, resilient planar portion integral with and directly connected to the flange portion and extending inwardly toward the valve stem, said flange portion restraining said planar portion from expanding radially, and a substantially tubular portion integral with the planar portion surrounding the valve stem and spaced therefrom, said tubular portion being formed with an intermediate portion adjoining said planar portion and a frusto-conical portion terminating in a circular lip to form a valve with said valve stem, said planar portion being formed to have an unstressed concave configuration with a negative angle of about 5° to 15° with a plane normal to the axis of the tube and said circular lip pressing against the intersection of said frusto-conical portion and cylindrical portion of said stem in the closed portion of said valve to stress said planar portion and reduce said negative angle by about 2°, and said planar portion having a flexed convex configuration with a positive angle of about 3° to 8° with a plane normal to the axis of the tube when said valve is opened by pressure on the tube and returning by the flexure to the stressed concave configuration when the pressure on the tube is released.

11. The closure unit of claim 10 wherein said diaphragm member has a maximum diameter of about 60 millimeters.

12. The closure unit of claim 11 wherein the diameter of said diaphragm member is about 20–35 millimeters and the negative angle of said stressed planar portion of said diaphragm member is about 10° to 12°.

13. A dispensing package comprising:

a container having at least one resilient wall; and a self-closing closure for said container comprising a spider member having a peripheral portion and an outwardly extending valve stem having an outer surface; and a diaphram member including a flange portion for interconnecting with the peripheral portion of the spider to form the closure unit, a relatively thin, resilient planar portion integral with and directly connected to the flange portion and extending inwardly toward the valve stem, the connection of the planar portion with the flange portion forming a plane and said flange portion restraining said planar portion from expanding radially, and a substantially tubular portion surrounding the stem and spaced therefrom, terminating in an open lip which makes a close, sliding fit with the outer surface of the stem to form a valve with the stem;

said planar portion being formed to have an unstressed concave configuration with said plane and said lip pressing against said stem to stress said planar portion and reduce said concave configuration when said valve is closed, and said planar portion having a convex flexed configuration when said valve is opened by pressure on the tube and said planar portion is forced by said pressure through said plane, and said planar portion returning by the flexure to the stressed concave configuration when the pressure on the tube is released.

14. The dispensing package of claim 13 wherein said container includes contents of flowable material.

15. The self-closing closure unit of claim 1 wherein said planar portion is formed with an unstressed concave configuration with said flange and said lip pressing against said stem to stress said planar portion and reduce said concave configuration when said valve is closed.

* * * * *